US006585576B2

(12) United States Patent
Chuang

(10) Patent No.: US 6,585,576 B2
(45) Date of Patent: Jul. 1, 2003

(54) ROLLERS' POSITION MOVING DEVICE FOR A SAND BELT MACHINE

(76) Inventor: Bor Yann Chuang, No. 78, Yungfeng Rd., Taiping Shiang, Taichung (TW)

( * ) Notice: Subject to any disclaimer, the term of this patent is extended or adjusted under 35 U.S.C. 154(b) by 0 days.

(21) Appl. No.: 09/826,886

(22) Filed: Apr. 6, 2001

(65) Prior Publication Data

US 2002/0146971 A1 Oct. 10, 2002

(51) Int. Cl.[7] ..... B24B 21/00

(52) U.S. Cl. ..... 451/300; 451/296; 451/299; 451/304; 451/489; 451/513; 451/526

(58) Field of Search ..... 451/296, 299, 451/300, 304, 489, 513, 526

(56) References Cited

U.S. PATENT DOCUMENTS 4,368,567 A * 1/1983 McMaster ..... 29/121.1
5,184,424 A * 2/1993 Miller ..... 451/304
5,830,046 A * 11/1998 Dugger et al. ..... 451/297
6,299,512 B1 * 10/2001 Costa et al. ..... 451/59

* cited by examiner

*Primary Examiner*—Joseph J. Hail, III
*Assistant Examiner*—Shantese McDonald
(74) *Attorney, Agent, or Firm*—Troxell Law Office PLLC

(57) ABSTRACT

A rollers' position moving device for a sand belt machine includes a conveyor in the machine, a sand belt, and plural rollers moving the sand belt. The rollers are deposited across on the conveyor. Further, a first wheel and a second wheel are pivotally connected with one side of each roller, and the first and the second wheel have different diameters so as to rotate with different speeds. The rotating speed disparity of the two wheels can make the two wheels move laterally right and left within a preset distance because of an inner projection surface of the two wheels. Then the rollers are rotated and moved laterally right and left by one of the wheels so that sand grinding of the rollers rotating and moving laterally right and left at the same time can grind a work being ground smooth and glossy.

4 Claims, 6 Drawing Sheets

ROLLERS' POSITION MOVING DEVICE FOR A SAND BELT MACHINE

BACKGROUND OF THE INVENTION

This invention relates to a rollers' position moving device for a sand belt machine, particularly to one moving rollers' position laterally back and forth to make the surface of a processed work more glossy than conventional machines do.

Conventional sand belt machines generally have a motor driving rollers with sand bands wound around to carrying out grinding by sand, but the rollers with the sand bands only rotate in one-way, hardly to grind a processed work perfectly to let its outer surface smooth and glossy. In addition, provided a work to be ground should have any projections, the sand belt might be easily partially scarred because of one-way rotation of the rollers with the sand bands. Should the operator of the sand belt machine not find out that occasion, letting the rollers continue to rotate, then the work being ground may have the same position not ground at all. So the conventional sand band machines are not ideal to use.

SUMMARY OF THE INVENTION

The objective of the invention is to offer a rollers' position moving device for a sand belt machine, which can move the rollers of the machine laterally back and forth during rotating so as to perform comparatively good grinding and to reduce potential damage on a work being ground.

BRIEF DESCRIPTION OF DRAWINGS

This invention may be understood better by referring to the accompanying drawings, wherein.

DETAILED DESCRIPTION OF THE PREFERRED EMBODIMENT

Figure 1:
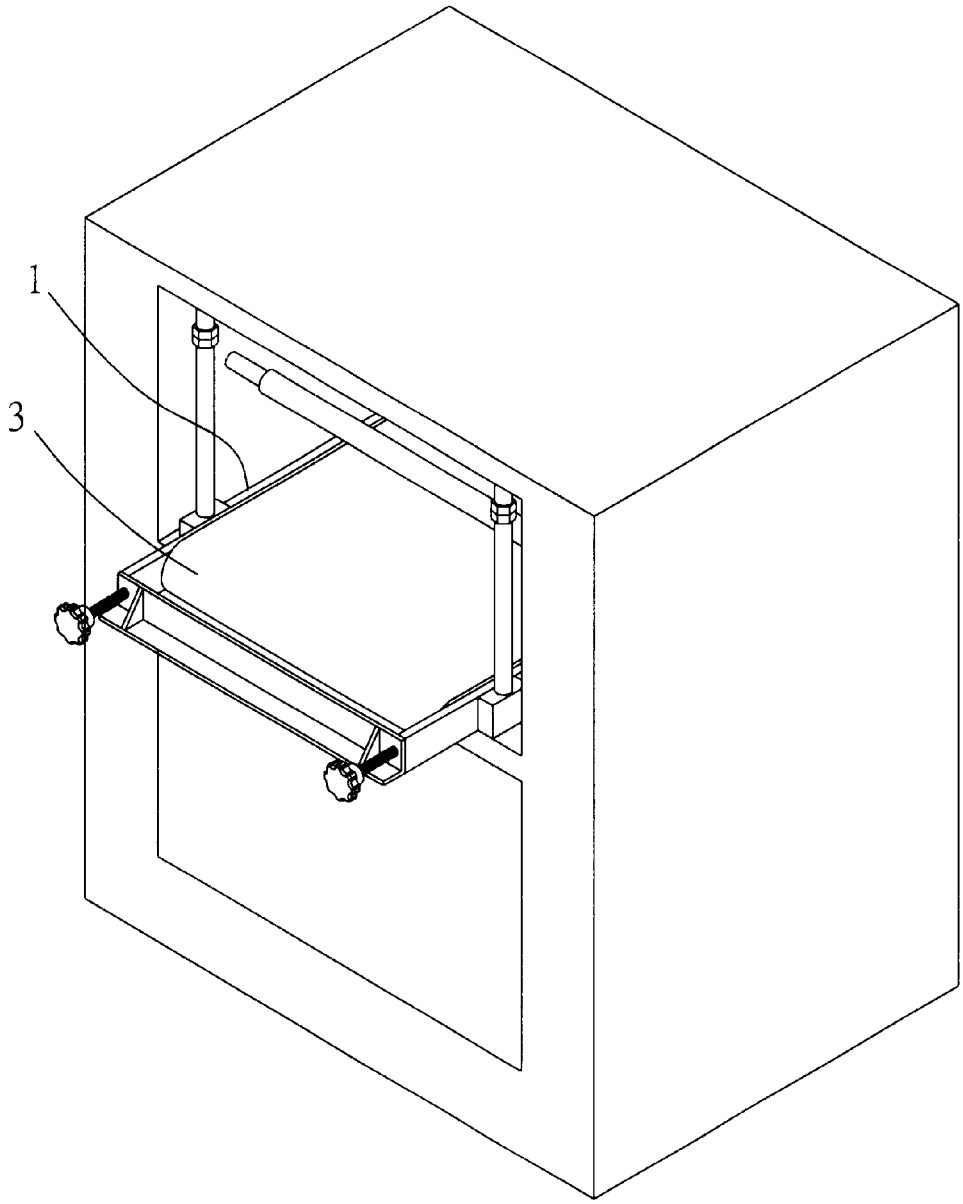
FIG. 1 is a perspective view of a sand belt machine provided with a rollers' position moving device in the present invention.
Figure 2:
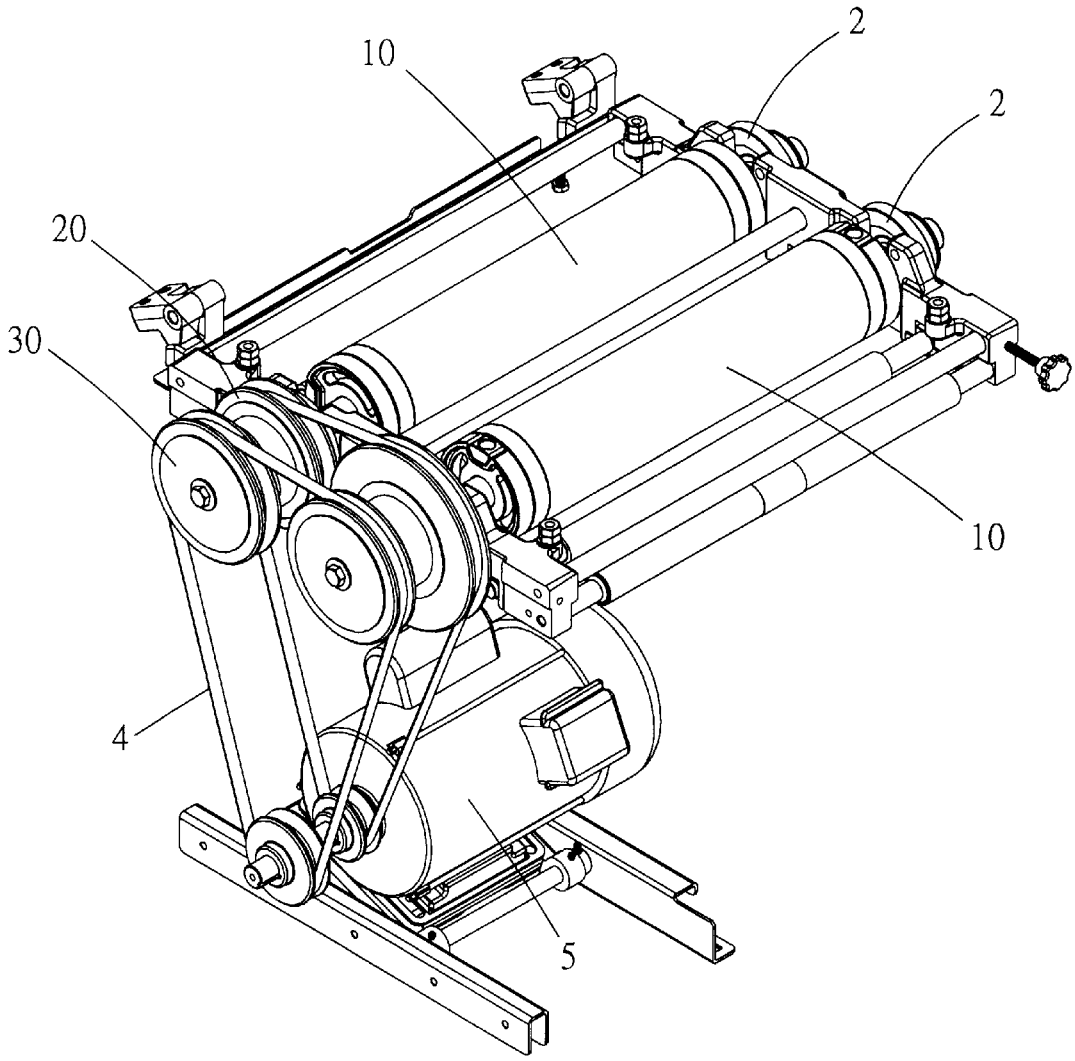
FIG. 2 is a partial perspective view of the rollers' position moving device for a sand belt machine in the present invention.
Figure 3:
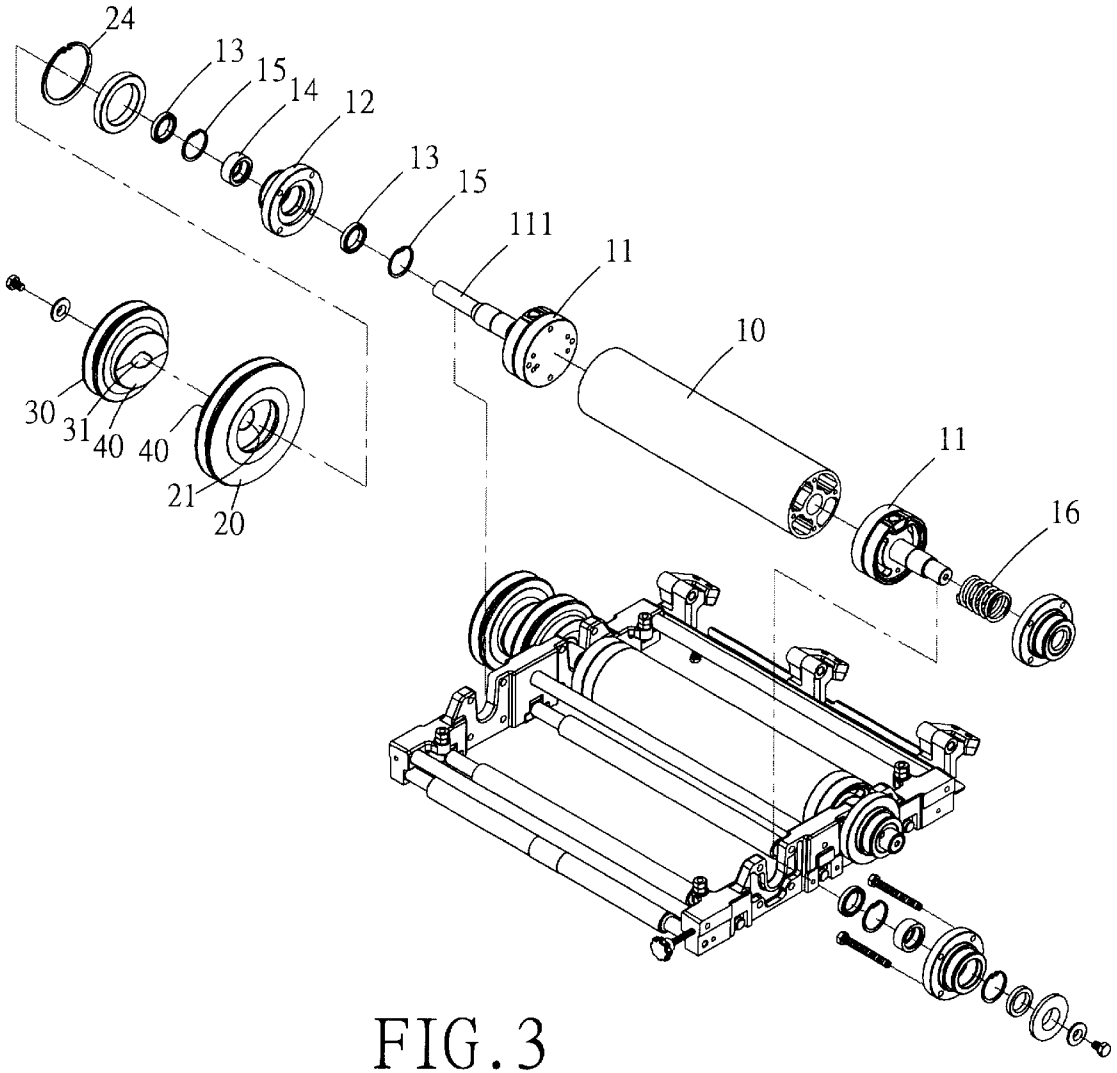
FIG. 3 is an exploded perspective view of the rollers' position moving device for a sand belt machine in the present invention.
Figure 4:
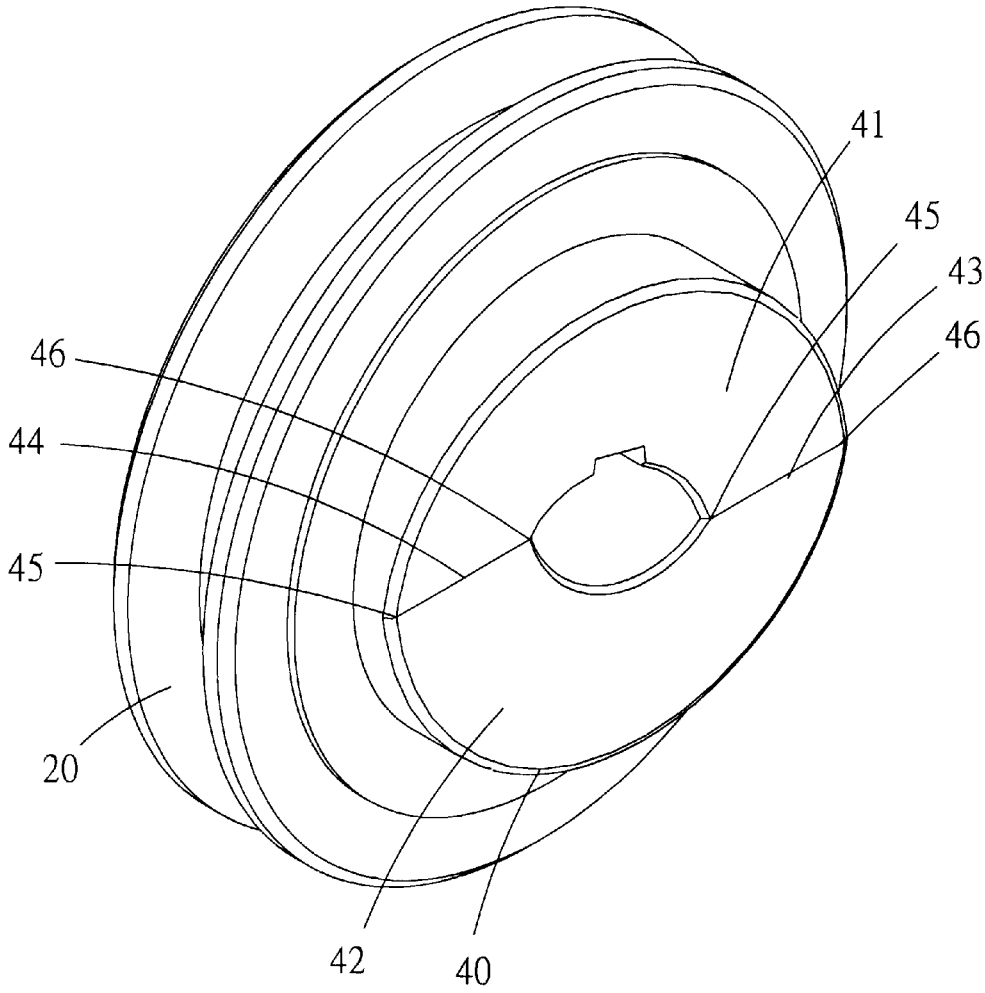
FIG. 4 is a perspective view of a first wheel in the present invention.

A preferred embodiment of a rollers' position moving device for a sand belt machine in the present invention, as shown in FIGS. 1, 2 and 3, includes a conveyor 1, two holes 2 formed respectively at two opposite sides of the conveyor 1, a sand belt 3 provided on the conveyor 1, two rollers 10 spaced apart side by side under the sand belt, two first wheels 20 and two second wheels 30 as main components combined together.

The two rollers 10 has a layer of a sand band wound around on their outer surfaces, a shaft supporter 11 provided respectively at two opposite sides of each rollers 10, a shaft 111 formed respectively to extend outward from each shaft supporter 11. Then each roller 10 is deposited across the conveyor 1 by the shafts 111 inserting in holes 2 formed in two opposite sides of the conveyor 1, and a bearing supporter 12 is pivotally connected with the outer side of the shaft 111 for containing pivotally two bearing rings 13 and a bearing 14. The two bearing bases 12 are respectively deposited at two sides of the bearing 14, two helical spring washers 15 are pivotally connected with the bearing supporter 12, and a spring 16 is fitted around the shaft 111 of the right shaft supporter 11.

The first wheels 20 are belt wheels of larger diameter than the second wheels 30, pivotally connected to an outer edge of the bearing supporter 12 with a helical spring washers 24, having a shaft hole 21 for the shaft 111 to pass through tightly and a protruding-out surface 40 formed in a left side. The protruding-out surface 40 consists of a first curved portion 41 and a second curved portion 42 abutting on each other with a first connect line 43 and a second connect line 44. The inner end of the first connect line 43 and the outer end of the second connect line 44 are formed with high projecting-out ends 45, and the outer end of the first connect line 43 and the inner end of the second connect line 44 are formed low ends 46, and the curved portions of the two curved portions 41 and 42 slope gradually down from the high projecting-out ends 45 to the low ends 46.

The two second wheels 30 are belt wheels of a smaller diameter than that of the first wheels 20, having a shaft hole 31 for the shaft 111 to pass through and able to rotate therein and a projecting surface 40 formed in a right side. The projecting surface 40 has the same configuration with that of the first wheels 20 to contact with each other by elasticity of the spring 16.

A transmitting belt 4 extends around the first and the second wheels 20 and 30 and rotated by a motor 5 so that the two rollers 110 may be rotated.

Next, movement and functions of the components are to be described below.

Figure 5:
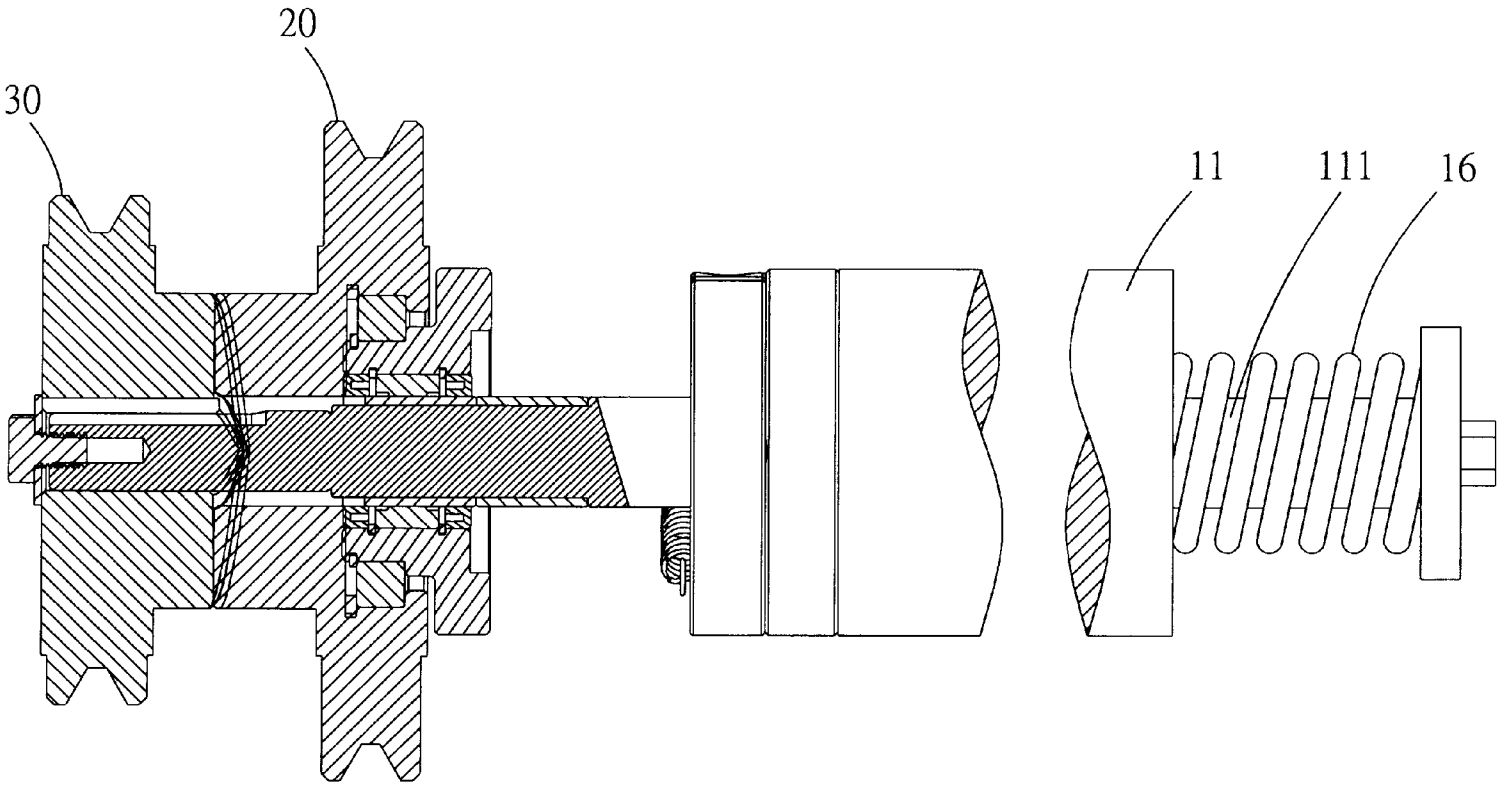
FIG. 5 is a side partial cross-sectional view of a second wheel under a motion in the present invention: and, FIG. 6 is a side partial cross-sectional view of the second wheel under another motion in the present invention.
Figure 6:
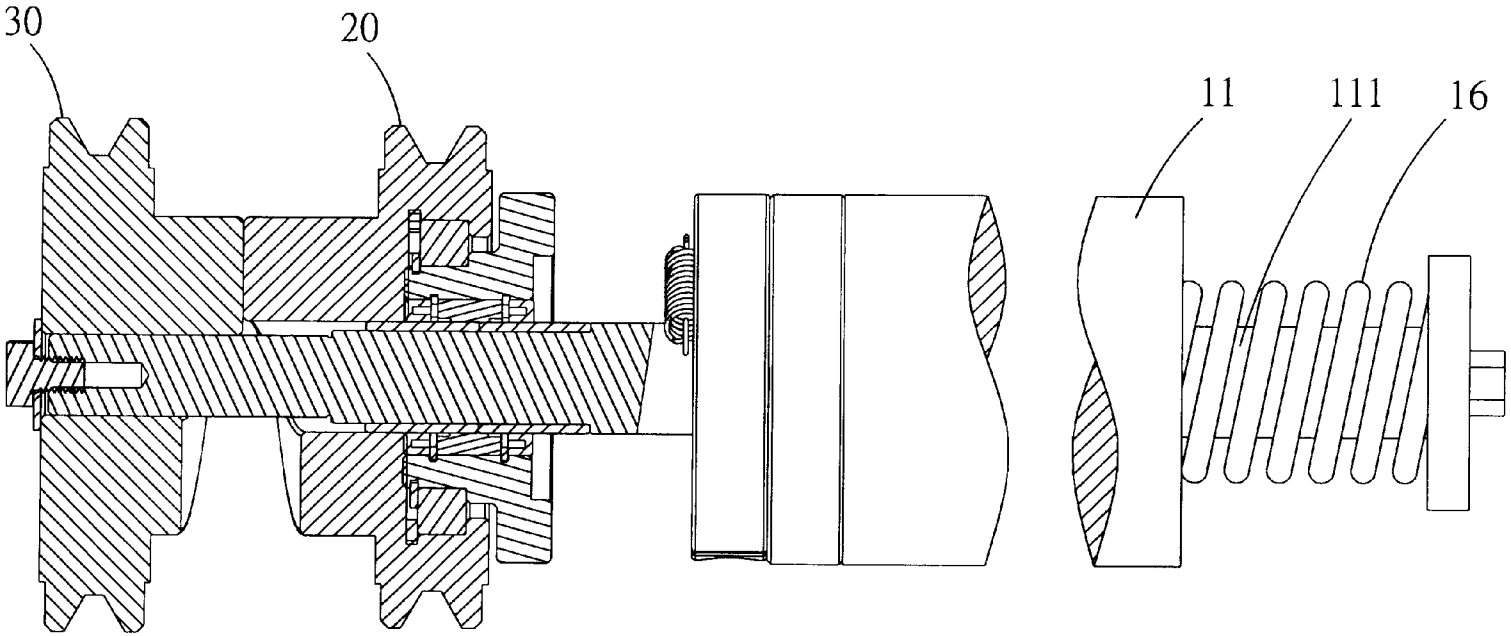

As shown in FIGS. 5 and 6, the first wheels 20 rotate in different speeds, as their diameter are different, producing rotating disparity between the first wheels 20 and the second wheels 30. As the projecting-out surfaces 40 of the first wheels 20 and of the second wheels elastically contact each other due to the springs 16, and the two pairs of the projecting-out surfaces 40 contact with each other at different locations. So the two pairs of the first and the second wheels 20 and 30 are located the nearest with each other when the high projecting-out ends 45 fit with the low ends 46, as shown in FIG. 5. But as shown in FIG. 6, if the high projecting ends 45 contact with each other, the two pairs of the first and the second wheels 20 and 30 are located the farthest from each other. Thus, even if the first wheels 20 and the rollers 10 move to the right side, their movement is slow and steady because the curved portions 41 and 42 slope gradually down from the high projecting-out ends 45 to the low ends 46. Further, the rollers 10 may gradually move to the left side by elastic pushing of the springs 16, and the rollers 10 are in tight condition with the first wheels 20, so rotated by the first wheels 20, performing rotation and lateral movement at the same time. Then if some location of the sand band is damaged, the damaged location of the sand band may not just stay at the same position of a work being ground, gaining better grinding effect.

In general, the main feature of the invention is the two rollers with different diameters rotate in the same direction with different speed, enabling the two wheels move laterally right and left in a preset distance so that rotating speed disparity may be set at a very small extent to let the two rollers move very slowly and steady.

If one of the first wheels is stopped immovable and the other can rotate and move also laterally right and left, it may perform the same function, but the high speed of the motor and direct action force may hardly fall down, causing fast wear and tear to the machine.

In addition, the sand band machine does not need to use an expensive speed reducer; position-moving speed can be achieved by using relative rotation of the two pairs of wheels to reduce productive cost.

While the preferred embodiment of the invention has been described above, it will be recognized and understood that various modifications may be made therein and the appended claims are intended to cover all such modifications that may fall within the spirit and scope of the invention.

I claim:

1. A roller positioning and moving device for a sand belt machine comprising:

a conveyor having a sand belt moved by a plurality of rollers, wherein:

said plurality of rollers extend across said conveyor and have said sand belt on outer surfaces;

first and second wheels connected with one end of each of said plurality of rollers, said first and second wheels having different diameters so as to rotate at different speeds from each other, such speed disparity causing lateral right-and-left movement of the associated roller within a preset distance, such that said plurality of rollers simultaneously rotate and move right and left.

2. The roller positioning and moving device for a sand belt machine as claimed in claim 1, wherein said first wheels are connected tightly to said rollers so as to rotate together.

3. The roller positioning and moving device for a sand belt machine as claimed in claim 1, wherein said first wheel and said second wheel respectively have inner projecting contact surfaces contacting each other; and further comprising a coil spring fitted around and acting on said rollers.

4. The roller positioning and moving device for a sand belt machine as claimed in claim 3, wherein each of said inner projecting contact surfaces has a first curved portion and a second curved portion abutting each other forming first and second connect lines, an inner end of said first connect line and an outer end of said second connect line formed with a high point, and an outer end of said first connect line and an inner end of said second connect line formed with a low point.

* * * * *